United States Patent [19]

Asselin

[11] 4,384,393

[45] May 24, 1983

[54] FELTING MACHINE FOR NON-WOVEN FABRICS

[75] Inventor: Pierre Asselin, Elbeuf, France

[73] Assignee: Establissements Asselin, Elbeuf, France

[21] Appl. No.: 187,635

[22] Filed: Sep. 16, 1980

[30] Foreign Application Priority Data

Sep. 28, 1979 [FR] France ..... 79 24222

[51] Int. Cl.[3] ..... D04H 18/00

[52] U.S. Cl. ..... 28/107

[58] Field of Search ..... 28/107, 110, 111, 113, 28/114, 108

[56] References Cited

U.S. PATENT DOCUMENTS 3,116,533 1/1964 O'Byrne ..... 28/110

3,129,486 4/1964 O'Byrne ..... 28/110

4,241,479 12/1980 Dilo ..... 28/107

FOREIGN PATENT DOCUMENTS 931611 7/1963 United Kingdom ..... 28/111

1322907 7/1973 United Kingdom ..... 28/113

*Primary Examiner*—Robert Mackey

*Attorney, Agent, or Firm*—Young & Thompson

[57] ABSTRACT

A felting machine for non-woven fabrics comprising a frame provided with a guide path for the fabric and two needle boards. Two crank-rod mechanisms are fixed to a beam of I-shaped cross-section. Each mechanism comprises two crank-rod units fixed on both sides of the web of the beam. These units are easily accessible through the front or through the rear of the machine in any operating position of the system.

15 Claims, 15 Drawing Figures

FELTING MACHINE FOR NON-WOVEN FABRICS

BACKGROUND OF THE INVENTION

1. Field of the Invention

The present invention relates to a felting machine for non-woven fabrics, of the type comprising, besides means for advancing the fabric, one or several boards provided with needles and an eccentric and connecting rod rise and fall mechanism to actuate this board with an alternating motion substantially vertical and perpendicular to the fabric in order to make the needles penetrate therein.

2. Description of the Prior Art

In known machines of this type, the eccentric/rod system generally operates in a transverse plane with respect to the advance of the fabric and the mechanism is advantageously fixed, to offer good stability, in a transverse box-beam. It results therefrom notably that access to the mechanism is difficult through the front or through the rear of the machine and necessitates the dismounting of at least one panel of the beam.

It is, if need be, possible to have access more conveniently to the mechanism through the top, but this possibility disappears if the machine punches from below. The mechanism is then in a bottom part and its access necessitates forming a pit beneath the machine.

Moreover, even if the machine ensures striking from above downwards, the supporting structure provided for the mechanism makes difficult access to the control members of the needle boards. This constitutes a severe constraint for the user, since by reason of the striking speed and the related balancing problems, these control members work under difficult conditions and require frequent overhaul, notably as regards the connecting rod mechanism.

It is an object of the present invention to provide a machine in which the mechanism, although fixed with all the solidity and stability desired, is easily accessible through the front or through the rear of the machine, without any dismounting.

It is another object of the invention, complementary to the preceding ones, to permit the production of a modular felting machine, that is to say adaptable without fundamental modification of the frame and of its appendages, for the execution of various types of felting for the same width of fabric.

GENERAL DESCRIPTION OF THE INVENTION

According to the invention, the felting machine for non-woven fabrics comprises a frame provided with a guide path for the fabric and means for advancing this fabric over said path, at least one board substantially parallel to the web and provided with needles, and a rise and fall eccentric and connecting rod mechanism to actuate this board with an alternating movement substantially perpendicular to the fabric, in order to cause the needles to penetrate into the fabric. It is characterized in that the mechanism is split into two crank-rod units coupled mechanically and arranged each on one side of the same beam placed transversely with respect to the direction of advance of the fabric.

The mechanisms are thus very easily accessible, some through the front of the machine, the others through the rear, whether the felting is done through the top or through the bottom.

In a preferred embodiment of the invention, the beam presents an I-shaped cross-section and its web is pierced by a succession of apertures equal in number to that of the pairs of coupled connecting rod-crank units, each aperture being traversed by a sleeve in which a crank-shaft is rotatably mounted whose excentric crank pins carry the connecting rod heads.

Each mechanism is situated entirely on one side of the web of the beam. It is hence not only accessible but completely visible.

In a particular embodiment of the invention, the rods of each crank-rod assembly traverse one of the flanges of the beam in holes arranged on both sides of the web.

The wide flanges of the beam, necessary for the stability of the machine and for its rigidity, are thus completely compatible with closing up one against the other in assemblies of the same pair.

According to an advantageous embodiment of the invention, each pair of crank-rod assemblies includes two fly-wheels provided with balance weights fast in rotation to the crank-shaft.

These weights enable balancing notably of the primary inertial forces of the parts in motion as well as the reversing torques generated by the guidance of the connection rod.

Preferably, the fly-wheels of each pair of crank-rod assemblies has a rim enveloping the ends of the sleeve passing through the beam and the annular balance weights are housed between the sleeve and the aforesaid rim.

This method of construction permits a particularly compact realization in the direction transverse to the beam, which reduces the span to be given to the crank-shaft.

According to an improved embodiment of the invention, the rotary drive means of each pair of crank-rod units comprise a drive pinion which is connected to one of the fly-wheels of the unit concerned by a notched belt mounted on the periphery of this fly-wheel.

The drive means of the rise and fall mechanism advantageously comprise a motor borne by the I-section beam of the frame, which actuates a distribution shaft mounted parallel to this beam, this shaft driving a set of drive pinions each connected to one of the pairs of crank-rod units positioned on each side of the web of the beam, each drive pinion receiving its movement from an angular counter-motion mechanism passing through the web of the beam.

The whole of the mechanical system is thus realized very compactly without its accessibility being affected.

According to an important improvement in the invention, the felting machine comprises means for coupling and guiding connecting rod small ends of each pair of crank-rod units in substantially vertical movement, these connecting rod ends being pivoted on the movable beam carrying the needle board.

These coupling and guide means comprise a common axle on which said connecting rod ends are articulated, and this axle bears also a connecting link rotatably mounted on it and pivoted through its two ends on two respective crank arms, themselves each articulated on the frame of the machine.

In this way, guidance without translational friction is obtained, which is thus practically without wear, even though the linear speeds are relatively high.

The coupling and guide means are advantageously borne by the lower flange of the beam and situated in the extention of the web of the latter.

According to an important feature of the invention, the felting machine comprises a certain number of pairs of crank-rod units, aligned transversely with respect to the direction of advance of the fabric, and each pair of crank-rod units of the beam is separated from the following pair by bracing partitions mounted between the flanges.

Correlatively, the felting machine has a modular structure, the pairs of crank-rod units being substantially identical with each other and interchangeable.

The felting machine may be designed so that each of the two connecting rods of the same pair is coupled to a separate needle board, or so that the two connecting rods of the same pair are coupled to the same needle board.

Other features and advantages of the invention will emerge from the detailed description which follows.

BRIEF DESCRIPTION OF THE DRAWINGS

In the accompanying drawings of embodiments of the invention given purely by way of non-limiting example.

DESCRIPTION OF PREFERRED EMBODIMENTS

Figure 1:
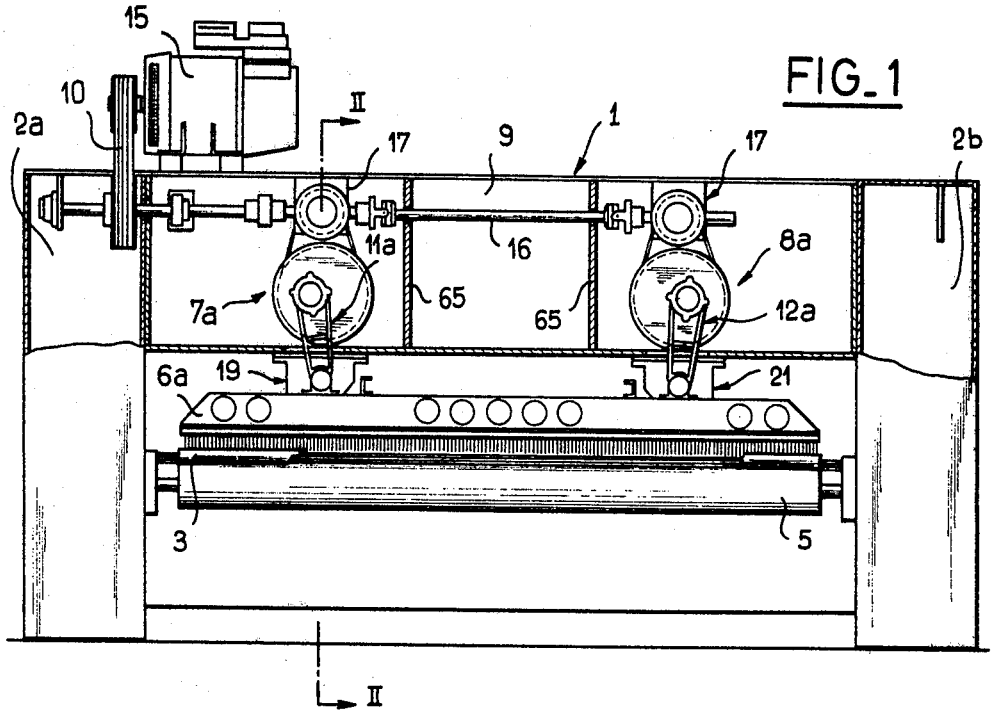
FIG. 1 is a view in elevation, from the front, of an embodiment of a felting machine according to the invention.
Figure 2:
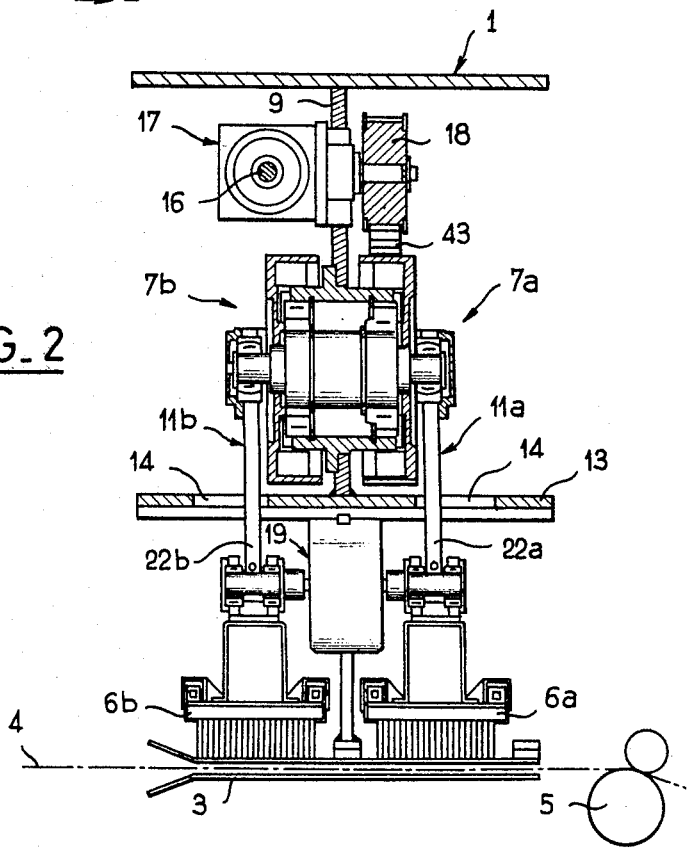
FIG. 2 is a sectional view along the line II—II of FIG. 1.
Figure 3:
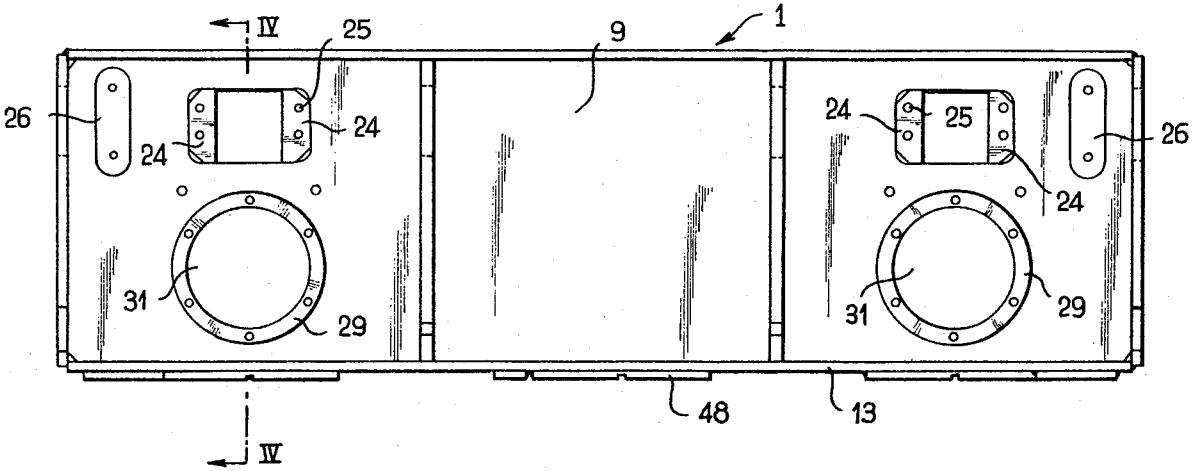
FIG. 3 is a view in elevation of the beam alone.
Figure 4:
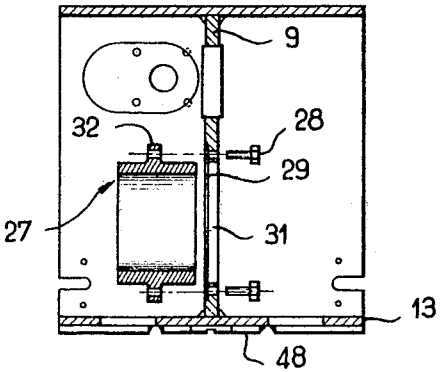
FIG. 4 is a sectional view along the line IV—IV of FIG. 3, with an exploded view of the sleeve.
Figure 5:
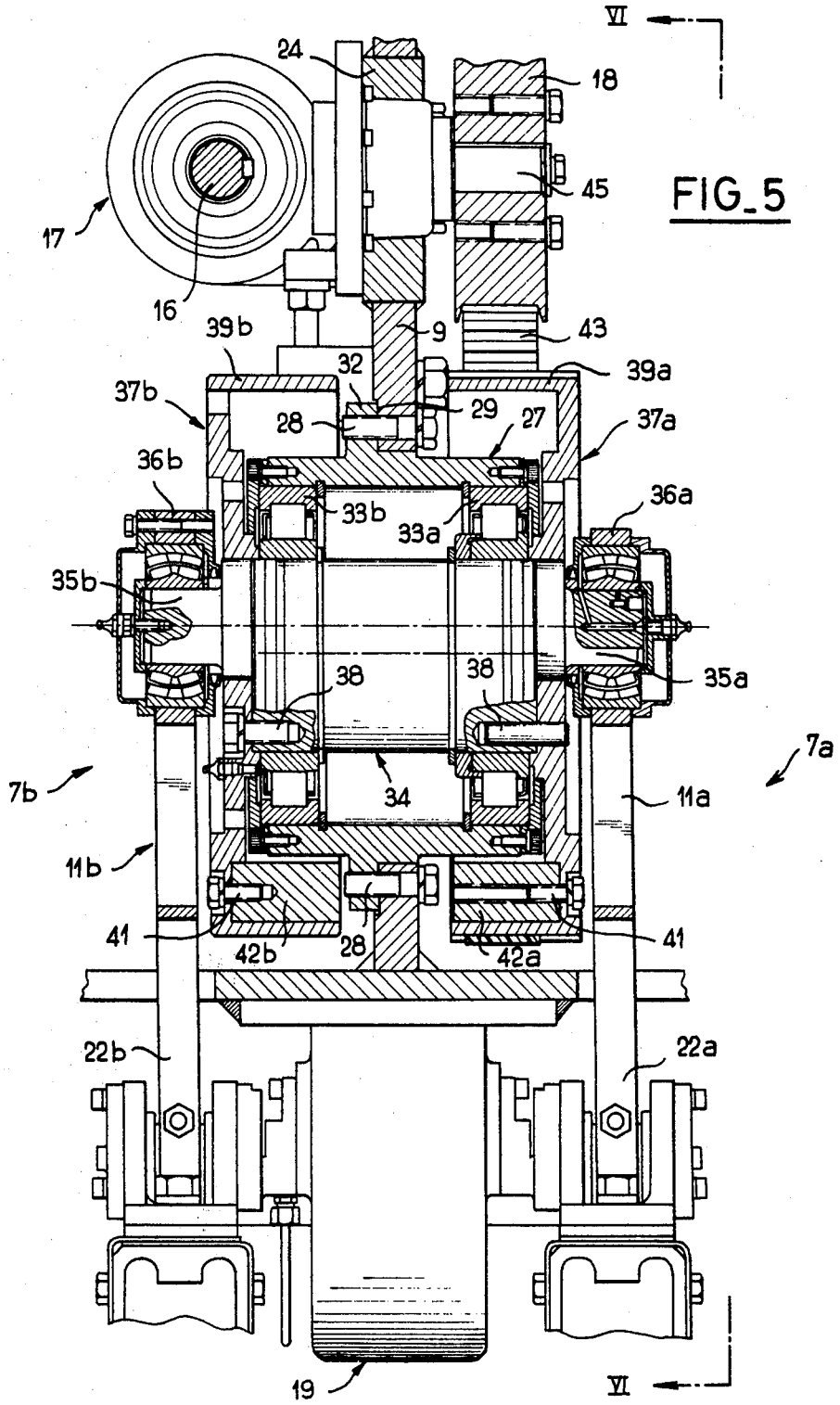
FIG. 5 is a profile view in partial section of a mechanical unit.
Figure 6:
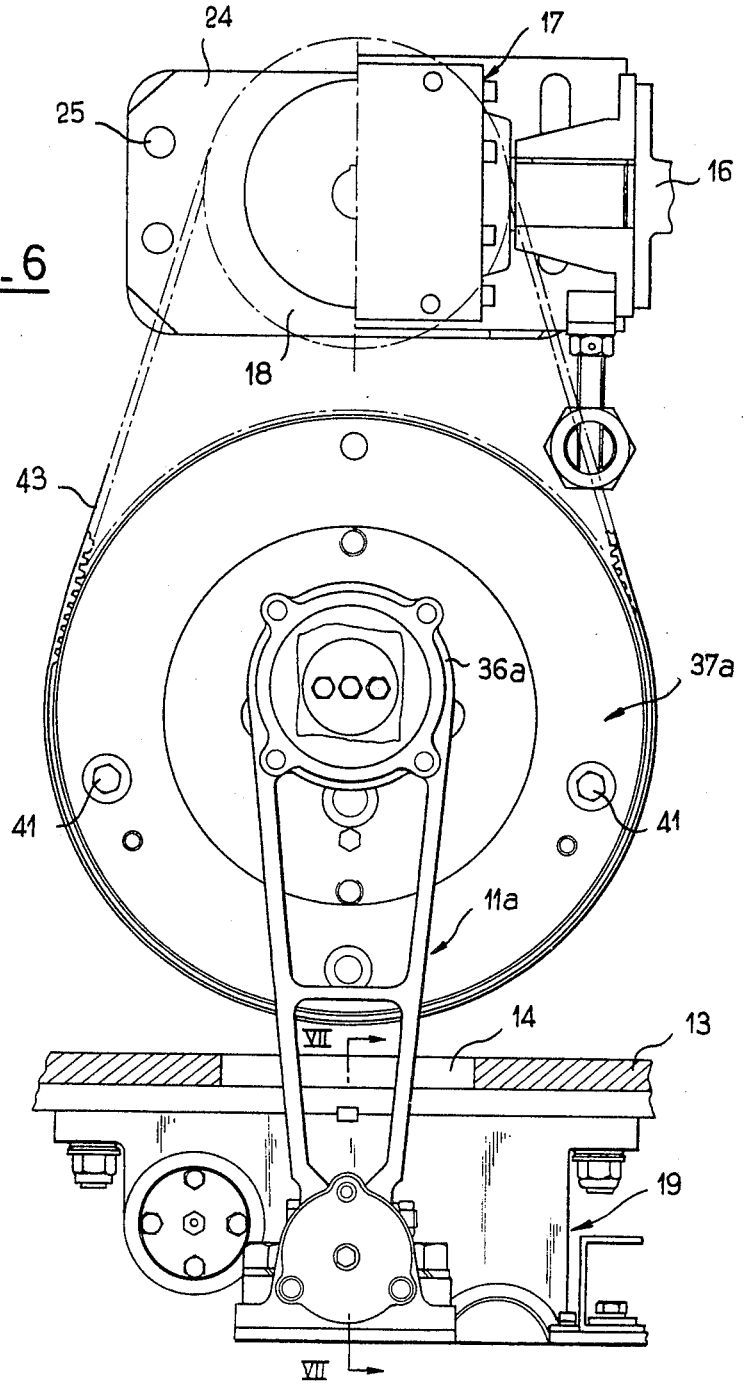
FIG. 6 is a front view of this mechanical unit, along the line VI—VI of FIG. 5.

Referring to FIGS. 1 and 2, a felting machine comprises an I-beam fixed on two pillars 2*a*, 2*b*, the whole constituting a frame for the felting machine. A track 3 is provided for the passage of a non-woven fabric 4 across the beam 1 under the action of known means comprising notably the rollers 5.

Two needle boards 6*a*, 6*b* are arranged above the track 3 and each connected to two rise and fall mechanisms to strike the sheet of fabric 4. Each of these mechanisms is itself composed of two crank-rod units, respectively 7*a*, 7*b* and 8*a*, 8*b*. The two units of a same mechanism are connected to two different boards indicated, in the drawings, by corresponding index letters (a or b).

The aforesaid mechanisms are fixed to the web 9 of the beam 1, the crank-rod units of a same mechanism being situated on each side of the web. The connecting rods 11*a*, 11*b* and 12*a*, 12*b* of these units pass through the lower flange 13 of the beam 1 through holes 14.

A motor 15 fixed to the beam 1 actuates through belts 10 a distribution shaft 16 borne by said beam and extending parallel to it.

Through angular counter-motion members 17, the shaft 16 actuates pullies 18 which transmit the motion to the units 7*a*, 7*b* and 8*a*, 8*b*.

Finally, systems 19, 21 for coupling and guiding the connecting rod ends 22*a*, 22*b* and 23*a*, 23*b* are fixed beneath the lower flange 13 of the beam 1 and substantially in extension of its web 9.

The crank-rod units composing the mechanisms will now be described in more detail, with reference to FIGS. 3 to 6. Only one of these mechanisms will be described, the other being substantially identical with it.

Reinforcements 24 are arranged in the web 9 of the beam 1 for the fastening of angular counter-motion units 17 by bolts in holes 25. Other reinforcements 26 are provided for the fastening of bearings supporting the shaft 16.

A sleeve 27 is fixed by bolts 28 on a plate 29 formed in the web 9 around the hole 31. This fastening is effected through a clamp 32 of the sleeve 27 arranged so that once fixed, the sleeve overlaps by substantially the same length on the two sides of the web 9.

On each side of the sleeve are locked bearings 33*a*, 33*b* carrying a crank-shaft 34 whose end crank ends 35*a*, 35*b* are pivoted in the heads 36*a*, 36*b* of the connecting rods 11*a*, 11*b*.

Two fly-wheels 37*a*, 37*b* are fixed to the crank-shaft 34 by bolts 38 and have rims 39*a*, 39*b* enveloping the ends of the sleeve 27. Inside these rims are fixed, by bolts 41, eccentric weights 42*a*, 42*b* forming balance weights.

The rim 39*a* is mounted so as to be driven by a notched belt 43 passing over the notched pulley 18 keyed to the output stub shaft 45 of the angular counter-motion mechanism 17.

Figure 7:
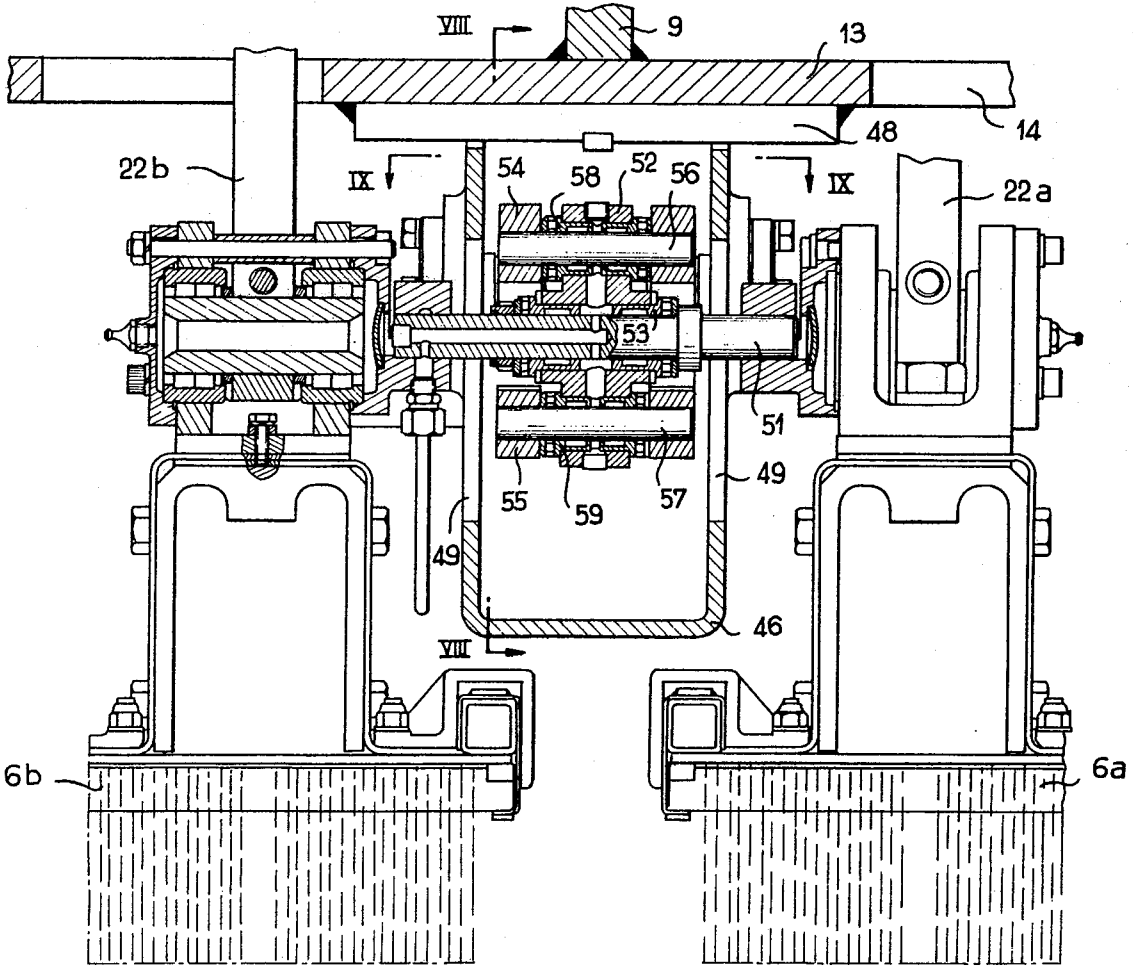
FIG. 7 is an enlarged view, in section along the line VII—VII of FIG. 6, showing the system of coupling and guiding the connecting rods.
Figure 8:
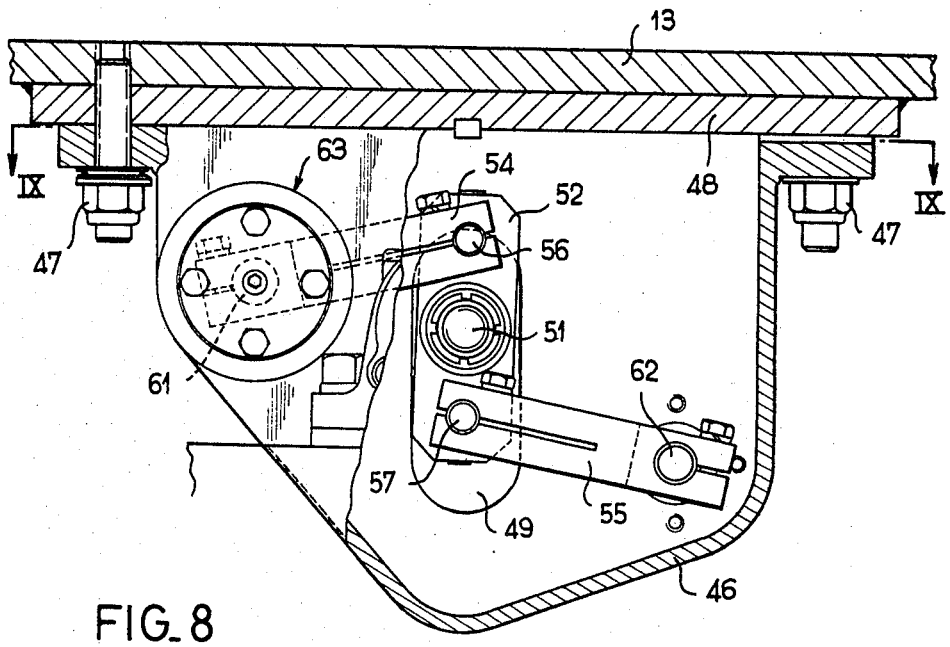
FIG. 8 is a lateral sectional view along the line VIII—VIII of FIGS. 7 and 9.
Figure 9:
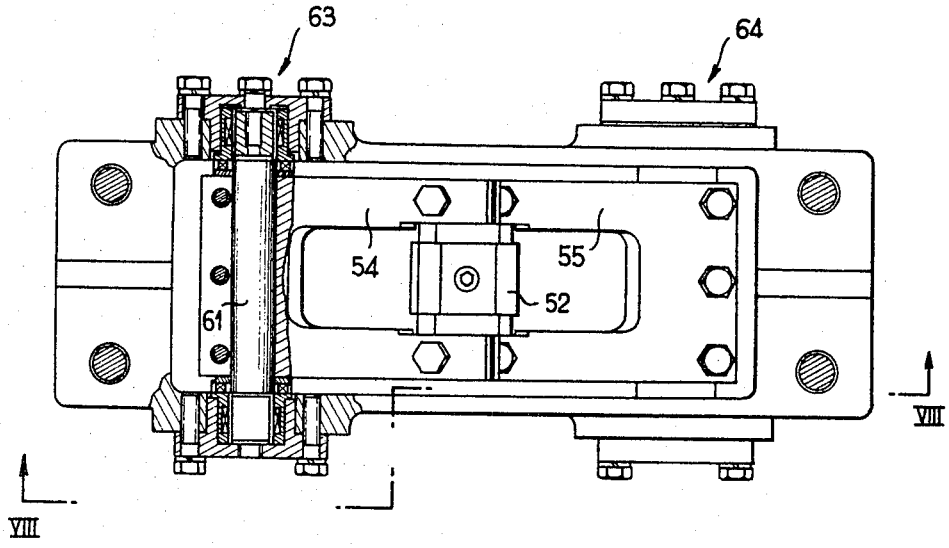
FIG. 9 is a sectional view in the plane along the line IX—IX of FIGS. 7 and 8, FIGS. 10 and 11 are overall front views of felting machines with respectively four mechanical modules and six mechanical modules.

The system of coupling and guiding the ends 22*a*, 22*b* of the connecting rods 11*a*, 11*b* will now be described in detail with reference to FIGS. 7 to 9.

A housing 46 is fixed by bolts 47 to a reinforcement 48 of the lower flange 13 of the beam 1. By means of two elongated openings 49, this housing, situated beneath the web 9 of the beam 1, is entirely traversed by a common axle 51 articulated on the two connecting rod small ends 22*a*, 22*b*.

Inside the housing 46, the axle 51 bears, substantially at its middle, a coupling link 52 rotatably mounted on it through a bearing 53.

At each of its ends, the coupling link 52 is articulated to the movable end of two respective crank arms 54, 55, through axles 56, 57 and bearings 58, 59.

Each of the two crank arms 54, 55 is mounted to oscillate on respective axles 61, 62 borne by bearings 63, 64 fast to the housing 46, hence to the frame of the machine.

The operation of the felting machine which has just been described will now be explained.

The sheet 4 being drawn regularly, the shaft 16, actuated by the motor 15, causes, through the angular counter-motion members 17, the rotation of the crank-shaft 34 of the two mechanisms and the oscillating movement of the needle boards 6*a*, 6*b*.

These angular counter-motion elements 17 are arranged so as to rotate the two mechanisms in reverse direction to one another, with a setting such that the connecting rods 11*a*, 11*b* on the one hand, and 12*a*, 12*b* on the other hand, are constantly symmetrical with respect to the longitudinal middle plane of the machine. The constancy of this setting is obtained through the notched belt transmission.

It emerges from the preceding description, and from the figures, that all the units such as *7a* are very easily accessible for the purposes of possible dismounting, some from the rear (index a), the others through the front (index b), without any dismounting other than that of a simple protective cover which moreover has not been shown and is not obligatory.

In spite of this visible and accessible character, the mechanisms are fixed to the frame in a very well-balanced manner, by reason of their symmetry with respect to the web 9 of the beam 1.

Another important advantage of the invention will emerge also from considering certain modifications in the construction.

Figure 10:
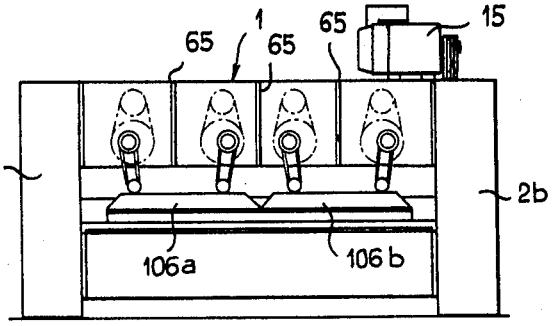
Figure 11:
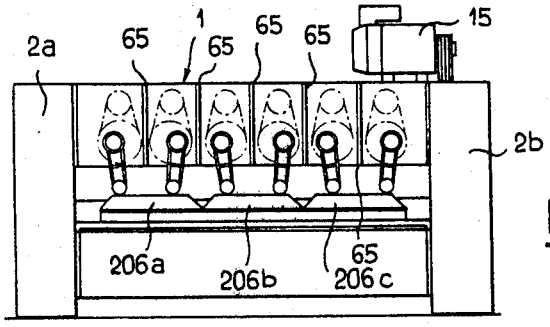

With reference to FIGS. 10 and 11, each needle board can be divided in the direction of the length into a certain number of segments, for example two segments 106*a*, 106*b* (FIG. 10), or three segments 206*a*, 206*b*, 206*c*, each of these segments being driven by a module of two mechanisms, one module being the whole of one of the mechanisms shown in FIG. 1. For the same useful width, a striking power respectively twice or three times greater is thus provided.

All the modules being identical, the economy in construction and maintenance which results therefrom is very considerable.

The various mechanisms thus aligned on the beam 1 are separated from one another by partitions 65 which play the role of stiffeners and which confer on the beam 1 a rigidity all the greater as the mechanisms which act on it are more numerous.

Figure 12:
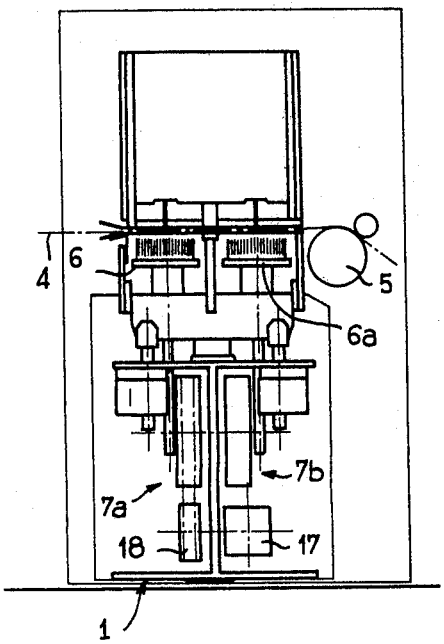
FIGS. 12 to 15 are sectional views of felting machines parallel to the direction of advance of the fabric according to various different embodiments of the invention.
Figure 13:
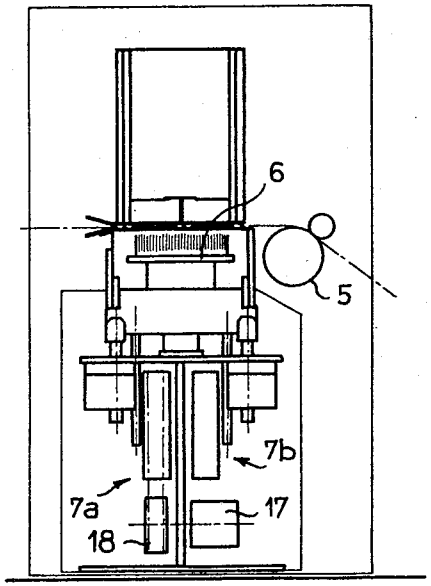

The invention preserves all its advantages in its application to an under-striking felting machine (FIGS. 12 and 13). In this case, the beam 1 is situated in bottom position and the crank-rod units *7a* and *7b* are again as easily accessible through the front or through the rear of the machine.

The underneath striking can be produced by two boards *6a*, *6b* (FIG. 12), or by a single board 6 (FIG. 13).

Figure 14:
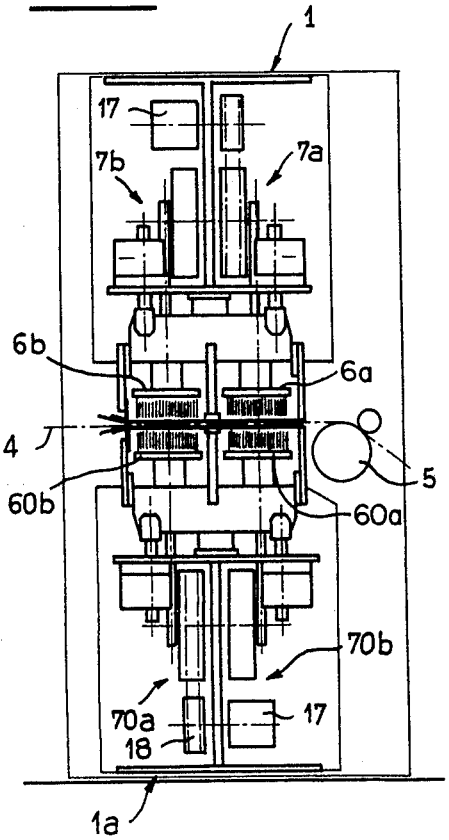

Two types of strike can besides be combined (FIG. 14). There are then provided two beams 1 and 1*a*, one above, the other beneath, which bear respectively units *7a*, *7b* actuating two upper boards *6a*, *6b* and units 70*a*, 70*b* actuating two lower boards 60*a*, 60*b*. All these crank-rod units are also perfectly accessible through the front and through the rear.

Figure 15:
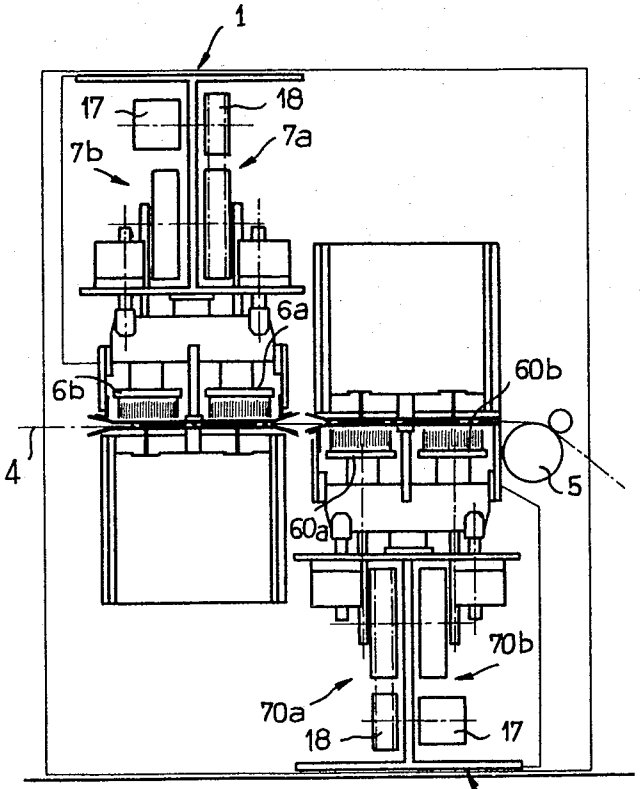

It is also possible to combine the two types of strike, no longer simultaneously, but successively (FIG. 15). The felting machine is then in practice split into two half-machines traversed successively by the fabric 4. One beam 1 is in upper position and one beam 1*a* is in lower position. The end units *7b* and 70*b* are directly accessible through the front and through the rear, respectively. As to the units *7a* and 70*a*, they are accessible almost as easily due to the upper and lower spacings left by the other half-machine.

Here again, all the mechanisms are practically identical and the modular character of the felting machine is preserved.

The invention hence enables a complete range of felting machines to be produced, capable of responding to all requirements while preserving its fundamental character of accessibility of the mechanism and of modularity.

Of course, the invention is not limited to the examples described but also covers any modification.

I claim:

1. Felting machine for non-woven fabrics, comprising a frame provided with a guide path for the fabric and means for advancing said fabric on said path, at least one board substantially parallel to the fabric and provided with needles, at least one eccentric and connecting rod rise and fall mechanism for driving said board with an alternating motion substantially perpendicular to the fabric, in order to cause the needles to penetrate the fabric, said mechanism comprising two crank-rod units, a crank-shaft which couples mechanically the said two crank-rod units, means connecting the said crank-rod units to the said at least one board, a beam positioned transversely with respect to the direction of advance of the fabric, said two crank-rod units being disposed on opposite sides of said beam, said beam having an I-shaped cross section comprising a web and an upper and a lower flange, a succession of apertures which pierce said web equal in number to the number of rise and fall mechanisms, a sleeve for each of the succession of apertures, which sleeve traverses each said aperture and has ends disposed on opposite sides of the web, each said crank-shaft being rotatably mounted in a said sleeve.

2. Felting machine according to claim 1, wherein each said crank-rod unit comprises rod connecting rod having rod head and a small end, and eccentric crank-pins on the crank-shaft which bear the said rod heads of the crank-rod units.

3. Felting machine according to claim 2, wherein said lower flange of the beam has a pair of openings for each rise and fall mechanism, one on each side of the web, through which the two connecting rods of each mechanism pass.

4. Felting machine according to claim 2, comprising means for coupling and guiding in substantially vertical movement connecting rod small ends of each rise and fall mechanism, these connecting rod small ends being articulated to the needle board.

5. Felting machine according to claim 4, wherein said means for coupling and guiding the connecting rod small ends of each pair of crank-rod units comprising a common axle on which said connecting rod small ends are articulated, a coupling link borne by and rotatably mounted on said axle and articulated through its two ends on two respective crank arms, themselves each articulated to the frame of the machine.

6. Felting machine according to claim 5, wherein the beam of the frame has an I-shaped cross section, wherein the rods of each rise and fall mechanism pass through one of the flanges of the beam symmetrically with respect to the web.

7. Felting machine according to claim 1, wherein each rise and fall mechanism includes two flywheels having annular balance weights fast in rotation with the crank-shaft.

8. Felting machine according to claim 7, wherein each said flywheel has a rims enveloping the ends of the sleeve passing through the beam and wherein the annular balance weights are housed between the sleeve and the aforesaid rim.

9. Felting machine according to claim 7, wherein each rise and fall mechanism has a rotary drive means which comprises a drive pinion, and a notched belt which connects said drive pinion to one of the flywheels of the associated said mechanism, which belt is mounted on the periphery of this flywheel.

10. Felting machine according to claim 1, comprising a plurality of rise and fall mechanisms and a drive means for the rise and fall mechanisms comprising a motor borne by the I-section beam of the frame, a distribution shaft mounted parallel to this beam which is actuated by the said motor, a group of drive pinions each connected to one of the rise and fall mechanisms placed on the web of the beam, said pinions being driven by said shaft, and an angular counter-motion mechanism passing through the web of the beam, which delivers motion to each said drive pinion.

11. Felting machine according to claim 1, comprising a plurality of crank-rod unit pairs aligned transversely with respect to the direction of advance of the fabric.

12. Felting machine according to claim 11, having an I-shaped cross section beam which comprises bracing partitions mounted between the flanges which separate each pair of crank-rod units of the beam from the following pair.

13. Felting machine according to claim 11, having a modular structure, said rise and fall mechanisms being substantially identical with one another and interchangeable.

14. Felting machine according to claim 1, wherein each of the two connecting rods of the same rise and fall mechanism is connected to a separate needle board.

15. Felting machine according to claim 1, wherein the two connecting rods of the same rise and fall mechanism are connected to the same needle board.

* * * * *